United States Patent [19]

Riggins et al.

[11] Patent Number: 4,528,433

[45] Date of Patent: Jul. 9, 1985

[54] ELECTRICALLY OPERATED SWITCH HAVING AN IMPROVED LINKAGE MEANS

[75] Inventors: Oral L. Riggins, Odon; Sherry J. Mills, Solsberry; John H. Warkentin; Joseph P. Stephans, both of Bloomington, all of Ind.; Clancy O. Wisdom, Mattapan, Mass.

[73] Assignee: Westinghouse Electric Corp., Pittsburgh, Pa.

[21] Appl. No.: 486,581

[22] Filed: Apr. 18, 1983

[51] Int. Cl.[3] ..... H01N 33/68; H01N 33/04

[52] U.S. Cl. ..... 200/150 C; 200/144 R; 200/148 H; 200/67 R

[58] Field of Search ..... 200/150 C, 148 H, 144 R, 200/147 R, 67 R, 67 A

[56] References Cited

U.S. PATENT DOCUMENTS

| | | | |
|---|---|---|---|
| 2,560,529 | 7/1951 | Van Ryan et al. | 200/147 R |
| 3,030,476 | 4/1962 | Date et al. | 200/150 C |
| 3,356,809 | 12/1967 | Colclaser, Jr. et al. | 200/148 H |

FOREIGN PATENT DOCUMENTS

| | | | |
|---|---|---|---|
| 1251705 | 12/1960 | France | 200/150 C |
| 479,850 | 2/1938 | United Kingdom | 200/150 C |
| 534828 | 3/1941 | United Kingdom | 200/148 H |

*Primary Examiner*—Robert S. Macon
*Attorney, Agent, or Firm*—Gorden H. Telfer

[57] ABSTRACT

There is provided in this invention an oil-filled electrical switch having a unique linkage and toggle mechanism that prevents the assembly from having a dead center position. There is also provided a stationary contact support structure upon which a rotary movable contact travels having openings in the structure for breaking up and cooling the arcs.

3 Claims, 9 Drawing Figures

ELECTRICALLY OPERATED SWITCH HAVING AN IMPROVED LINKAGE MEANS

BACKGROUND OF THE INVENTION

This invention relates generally to electrical switching equipment and more particularly to oil-filled electric switches.

DESCRIPTION OF THE PRIOR ART

This invention provides an improvement over the type of switch described in U.S. Pat. No. 3,309,636 issued to Robert W. Price and assigned to the assignee of the present application. These switches are generally oil-filled single pole switches supplied for manual and/or electric operation. Their principal application is to switch capacitor banks, outdoor lighting circuits, and for load break sectionalizing on rural and suburban distribution systems. They may be operated as single pole units or ganged manually or electrically for multipole applications. Their biggest advantage is their simplicity and ruggedness in harsh environments.

The present designs utilize a rotary acting moving contact that engages a stationary contact in an oil-filled tank. An object of this invention is to provide a moving contact and stationary contact combination that would reduce the size of the overall switch thus reducing the amount of oil required. Another object of this invention is to provide a stationary contact support that also acts as an arc chute for faster arc extinction.

SUMMARY OF THE INVENTION

There is provided by this invention a novel rotary acting moving contact positioned in a horizontal plane that effectively reduces the depth of the oil and the tank required while maintaining existing BIL levels. Also included in this design is an improved type toggle that incorporates a slot at the mid-point of the toggle mechanism creating an inclined plane that prevents the assembly from having a dead center position. As the assembly rotates, the mid-point pin will be forced to one end of the slot, as the assembly continues toward the point where the forces are in alignment the plane of the slot has now tilted and the forces will cause the pin to snap to the opposite end. This sets in motion the forces that will cause the switch contacts to reverse position.

BRIEF DESCRIPTION OF THE PREFERRED EMBODIMENT

Figure 1:
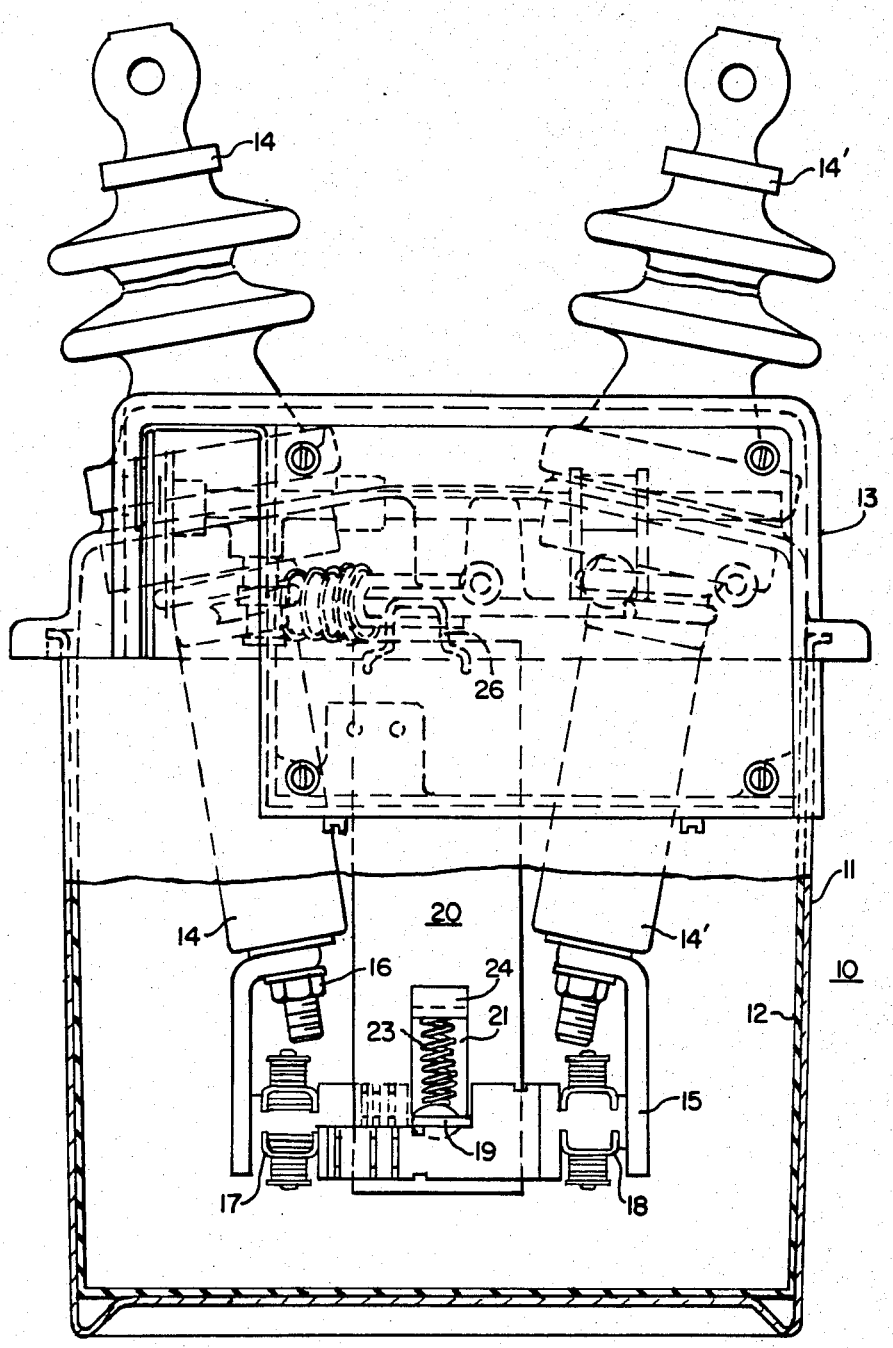
FIG. 1 is a side view partially in cross section of a switch incorporating the principals of this invention.
Figure 2:
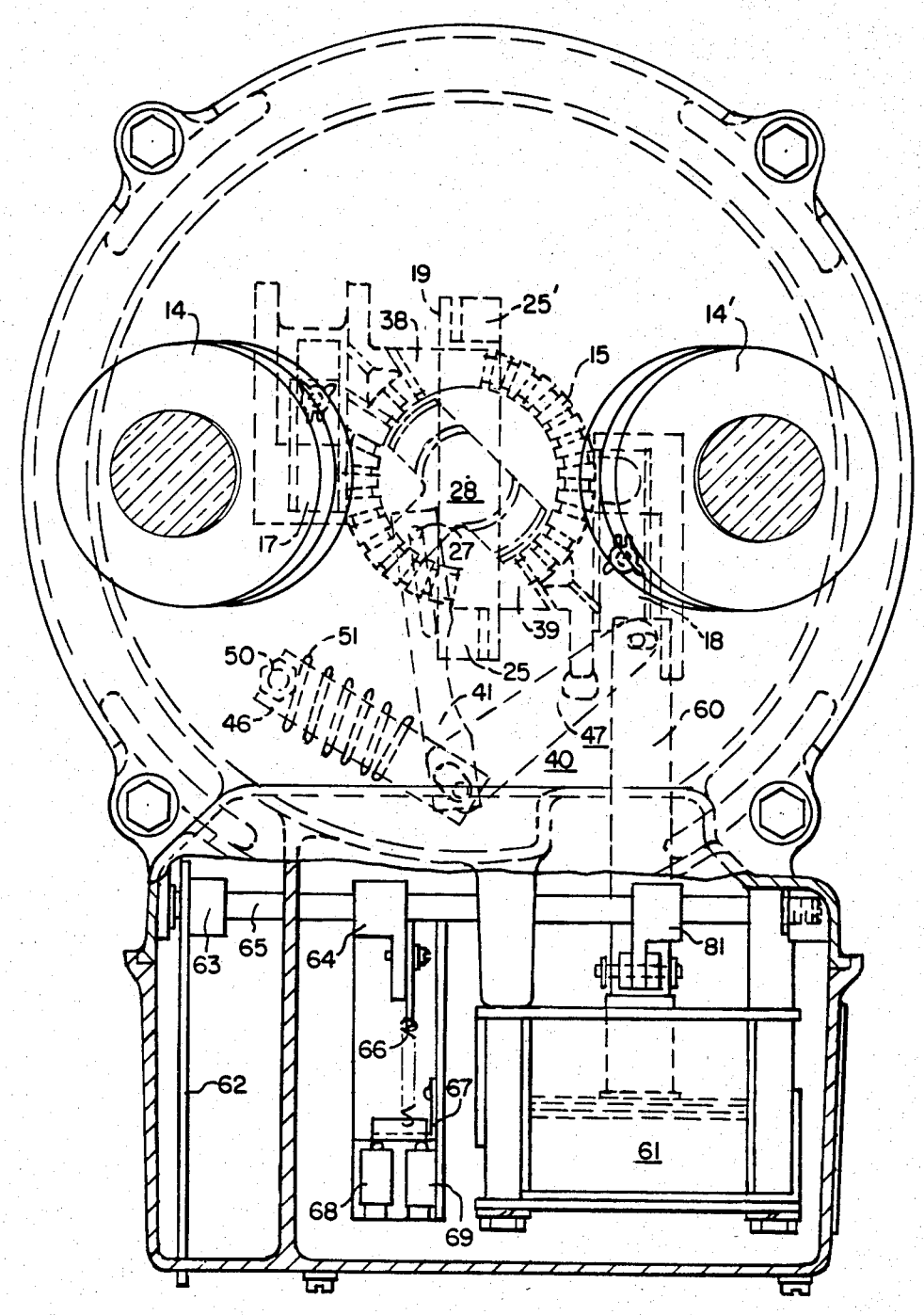
FIG. 2 is a top view of the switch shown in FIG. 1.

Referring to FIGS. 1 and 2 there is shown a switch generally designated 10 and closed in a metal tank 11 which is provided with an insulated liner 12 and which is surmounted by a top casting 13. Terminal bushings 14 and 14' are mounted in the top casting 13 each with a conducting stud passing through the bushing. Incoming lines enter the metal tank 11 through bushings 14 and 14'. The stud and bushing 14 terminates inside the tank as a threaded stud portion or threaded rod, which is electrically connected to a fixed contact in a manner hereinafter described in detail. The other end of the two bushings also has a threaded stud portion terminating at its bottom for electrical connection to a fixed contact.

Figure 4:
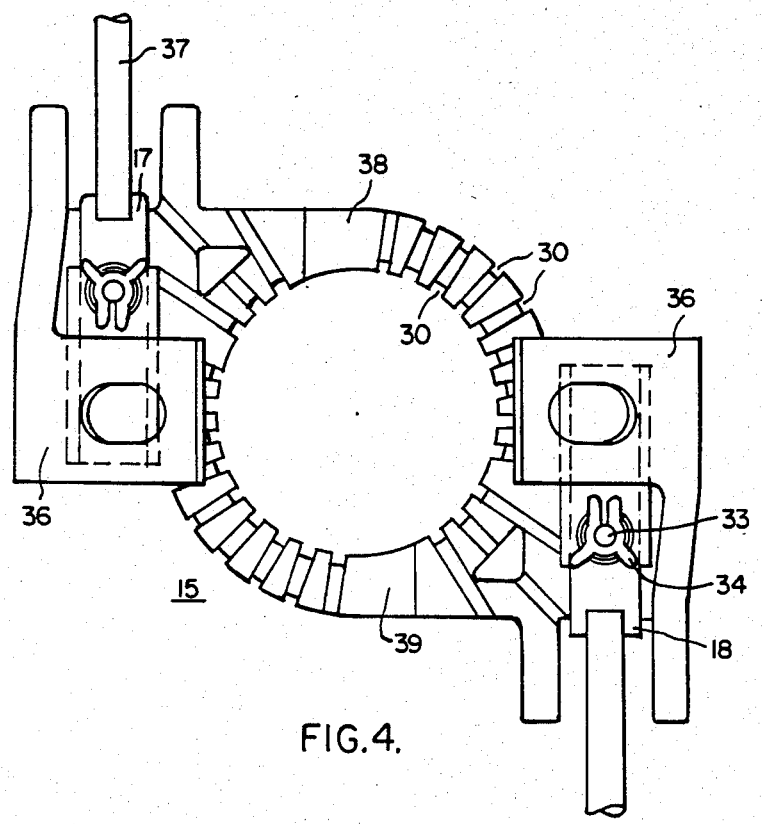
FIG. 4 is a top view of the structure shown in FIG. 3.
Figure 3:
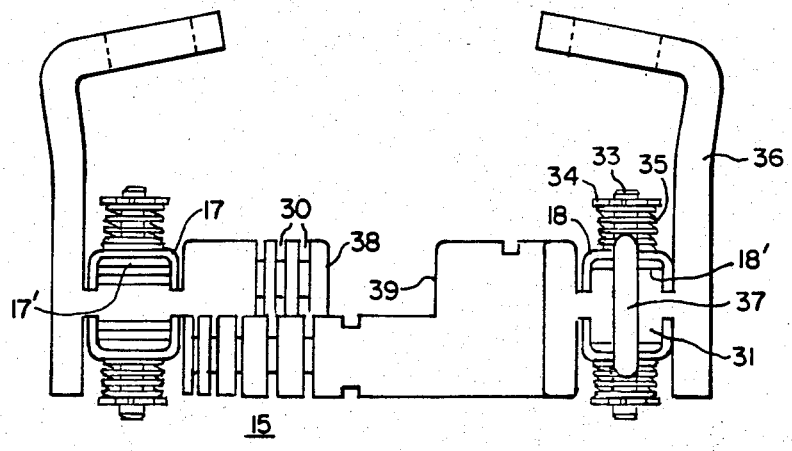
FIG. 3 is an exploded elevational view of the stationary contact support structure.
Figure 6:
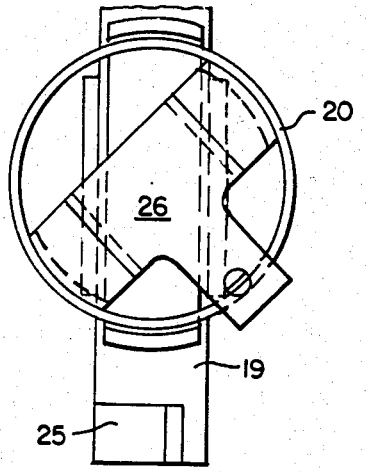
FIG. 6 is a top view of the structure shown in FIG. 5.
Figure 5:
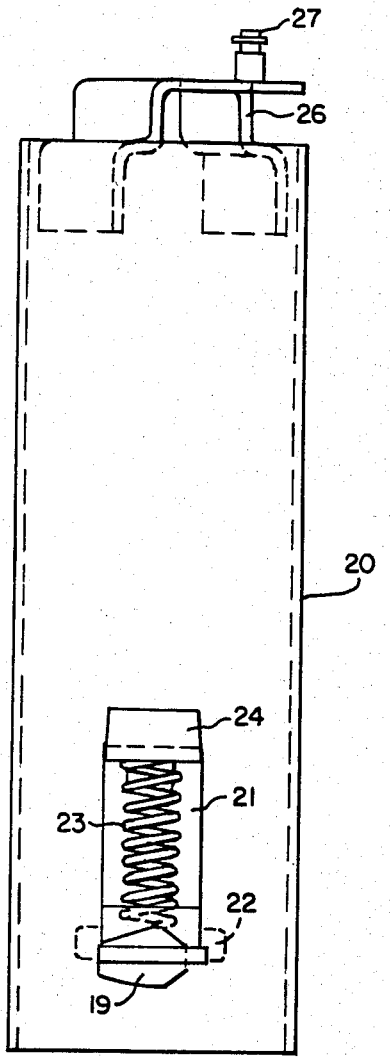
FIG. 5 is an exploded elevational view of the movable contact support structure.

A molded insulating contact support structure 15 is attached to the threaded stud sections of the terminal bushings 14 and 14' by means of nuts 16. Stationary contact terminals 17 and 18 are mounted on the molded insulating support member and are disposed to receive a movable contact terminal 19 supported on a rotary contact cylinder 20. FIGS. 3 and 4 show detailed views of the molded insulating contact support 15. The contact support 15 is generally a cylindrical member having grooves or slots 30 formed therein whose function will be explained hereinafter in detail. Projections 31 are formed on the cylindrical contact support member 15 to support the stationary contact terminals 17, 18 which mount on the projections in a saddle-like manner. Locking pins 33 pass through the stationary terminals 17, 18, and the projection in the stationary contact support member 31, and is secured by a lock washer 34 placed over biasing springs 35 that supply contact pressure for electrical connection in the stationary contact assembly. The stationary contact terminals 17, 18 have welded or brazed thereto contacts 17' and 18'. Additionally, finger like projections 36 are provided to attach the stationary contact support assembly to the terminal bushings 14, 14'. The stationary contact terminals 17, 18 have attached thereto small conductors 37 that are connected to the terminal bushings 14 and 14' to connect the stationary contact assembly in series with the incoming and outgoing conductors of the circuit interrupter apparatus 10.

Referring now to FIGS. 1, 2, 5, and 6 there is shown a generally elongated cylindrical movable contact carrier 20 that is positioned in the center of the stationary contact support 15 having a movable contact terminal 19 mounted at the lower end thereof and the upper end extending into the top casting 13 which is connected to the operating mechanism described in greater detail hereinafter. The movable contact 19 is mounted within a slot 21 in the movable contact carrier 20. A biasing spring 23 is mounted between the nylon retainer 22 and a top retainer 24 supporting the movable contact 19 in position and supplying additional contact pressure. The movable contact 19 extends through the movable contact carrier 20 having brazed or welded thereto contacts 25 and 25' at opposite ends of the movable contact terminal 19. As can be seen in FIGS. 1 and 2 the movable contact carrier 20 is mounted generally within the center of the cylindrical stationary contact support 15 in a position such that the movable contact terminal 19 rests upon the stationary contact support 15 between extended projections 38 and 39 that serve as stops for the movable contact terminal 19 when the circuit breaker apparatus is in its normally open position. The upper end of the movable contact carrier 20 has connected thereto a movable contact actuator 26 having a pin 27 for connection to the operating linkage.

Figure 7:
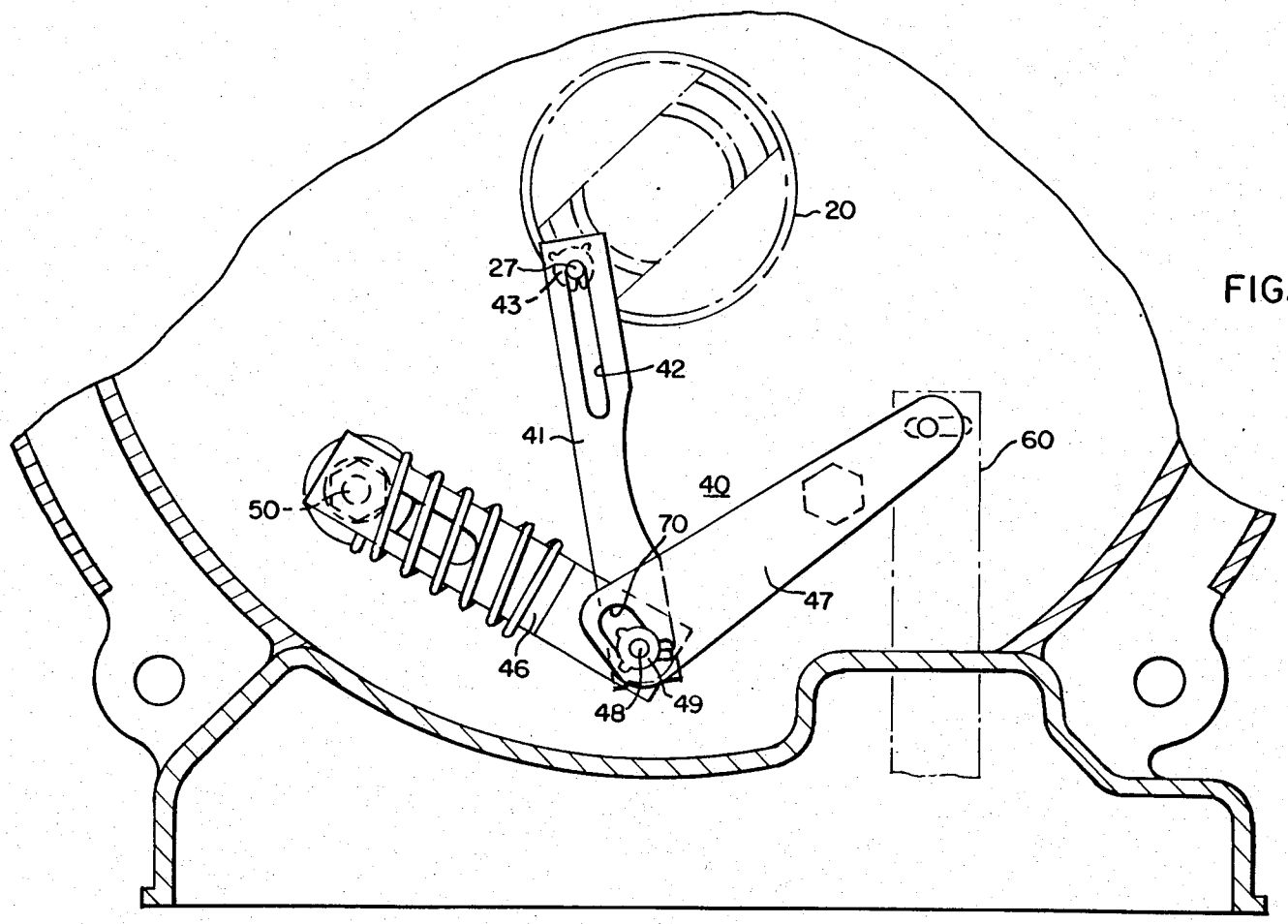
FIG. 7 is an exploded view of the toggle assembly.

Referring now to FIGS. 1, 2, and 7 there is shown supported in the top casting 13 an operating mechanism 40 that controls the rotary action of the cylindrical movable contact carrier 20. The operating mechanism 40 is generally comprised of a first linkage arm 41 having an elongated slot 42 that connects to the actuator pin 27 by means of the lock washer 43. The end of the linkage arm 41 is pivotally connected to linkage arms 46 and 47 by means of a pin and lock washer 48 and 49. The linkage arm 46 has an elongated slot which is connected to the top casting 13 by bolt 50. A compression spring 51 whose function will be explained hereinafter is secured over the linkage arm 46. The other end of the linkage arm 47 is secured by a pin and washer arrangement to the armature 60 of an electromagnetic device 61 that controls electrical operation of this circuit interrupter apparatus. Referring to FIG. 7 there is shown an exploded partial sectional view of the top casting 13 having mounted therein the operating mechanism 40. The operating mechanism 40 has a slot 70 at its midpoint that functions to prevent the assembly from having a dead center position. As the armature 60 is actuated the linkage arm 47 is rotated in a clockwise direction, causing rotation of linkage arm 46 in a counterclockwise direction, and further causing linkage arm 41 to rotate the movable contact cylinder 20 in a clockwise direction. As the linkage arms rotate, the mid-point pin 48 will be forced to one end of the slot 70, as the assembly continues toward where the forces are in alignment (linkage 46 and 47 in nearly a straight line configuration) the plane of the slot 70 has now tilted and the forces will cause the pin to snap to the opposite end. This sets in motion the forces that will cause the switch contacts to reverse position.

Actuation of the operating means 40 causes the movable cylindrical contact carrier 20 to rotate the movable contact terminal 19 in a rotary direction from the stops 38 and 39 toward the stationary contact terminals 17 and 18. The movable contact terminal 19 is biased by the biasing spring 21 so that the movable contact 19 moves substantially upon the generally cylindrical surface of the stationary contact support 15. Upon separation of the movable contact terminal 19 from the stationary contact terminals 17 and 18 any arcs drawn between the terminal contacts 25, 25' and 17, 18' will be forced to propagate across the slots 30 in the stationary contact terminal support structure 15 whereby the slots 30 aid in cooling and extinguishing of the arcs. The elevated stops 38, 39 on the stationary contact terminal support structure 15 provide a positive stop, contact isolation in the open position and support for the operating rod.

Figure 8B:
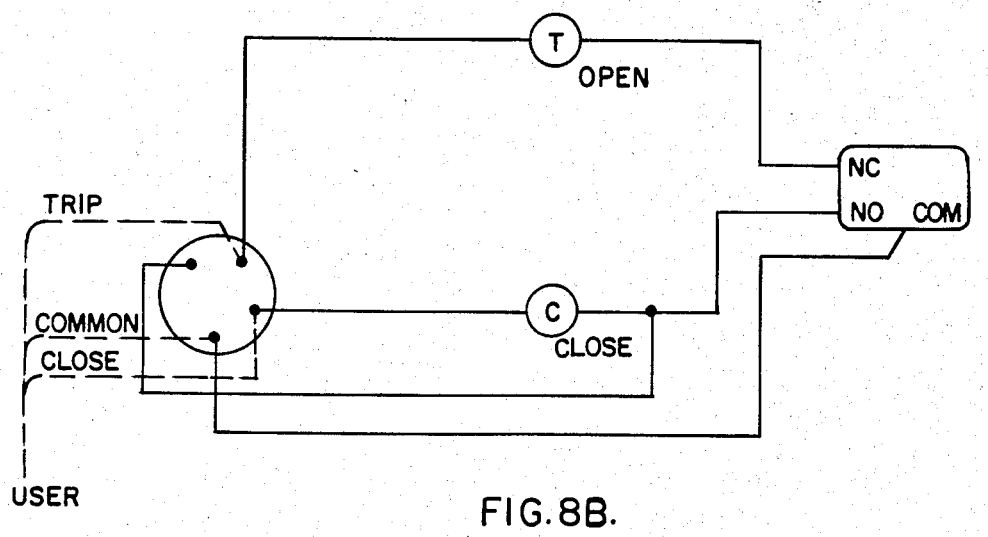
FIGS. 8 and 8A are wiring diagrams illustrating electrical operation.
Figure 8A:
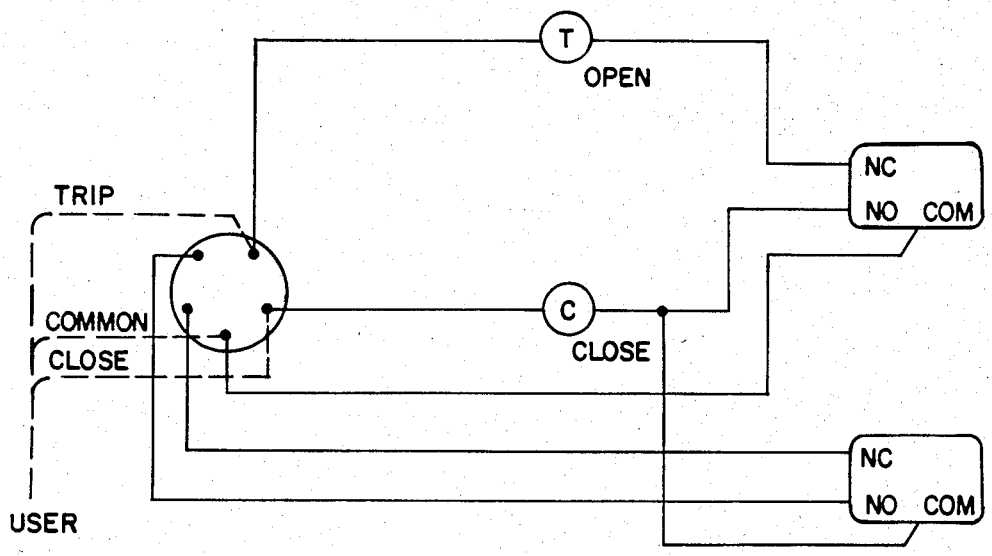

As previously stated, the main switch contacts of the circuit interrupter apparatus are open by means of a magnetic trip solenoid when energized, and the main switch contacts are closed by means of a magnetic closed solenoid when the closed solenoid is energized. The trip and closed solenoids are interlocked by means of microswitches 68 and 69. The aforementioned armature 60 being a part of the manual operating mechanism 40 is connected by means of a pivot pin 81 to a rotating shaft 65 which is mounted in the top cast housing 13. An operating lever 62 is connected to the rotating shaft 65 by means of a cantilever pin 63. Rotating the shaft 65 by means of the handles 62 moves the solenoid shaft 60 to operate the contacts by means of the toggle mechanism to its opened and closed positions. The rotating shaft 65 also has connected cantilever pin 64 which is connected by means of a spring 66 to a slidable trip arm 67 disposed to operate a pair of microswitches 68 and 69 connected to the electrical control circuit. The microswitches are used to interlock the open solenoid from the closed solenoid of the electromagnetic device 61 in the control circuits of FIGS. 8A and 8B.

Although there has been illustrated and described a specific embodiment, it is clearly understood that the same were merely for purposes of illustrations and that changes and modifications may be readily made therein by those skilled in the art without departing from the spirit and scope of this invention.

What we claim is:

1. Electrical switch apparatus, comprising:

(a) a rotary contact means and stationary contact means combination disposed to open and close an electric circuit;

(b) operating means including a toggle mechanism for effecting rotary movement of the rotary contact means into engagement with the stationary contact means;

(c) the rotary contact means and stationary contact means combination being supported by a generally cylindrical support structure connected thereto over which the rotary contact means travels with spaced openings in the structure to aid in the breakup and extinguishing of arcs; and (d) the toggle mechanism having a slot creating an inclined plane at the midpoint of the mechanism preventing the toggle mechanism from having a dead center position.

2. Electrical switch apparatus comprising:

an oil filled housing with a pair of conductive studs extending within said housing from a pair of terminal bushings on the exterior of said housing;

a stationary contact support structure of insulating material within said housing having a generally cylindrical configuration with a central opening and with a pair of stationary contacts, respectively connected to said pair of conductive studs, located substantially diametrically across from each other;

a movable contact carrier structure disposed within said central opening of said stationary contact support structure, a movable contact element mounted on said movable contact carrier structure, said movable contact element having a pair of contacts at extremities thereof for engagement, in the closed position of the switch, with said pair of stationary contacts, said movable contact element being arranged for rotational movement between the closed position and an open position of the switch with said movable contact element bearing against and moving on said stationary contact support structure;

said stationary contact support structure having stops for limiting movement of said movable contact element in the open position and having a portion with a surface against which said movable contact element moves with a plurality of slots extending from said surface and along the sides of said portion of said stationary support structure that cause extinguishment of arcs formed when said movable contacts separate from said stationary contacts; and, an operating means for effecting rotary motion of said movable contact element.

3. Electrical switch apparatus in accordance with claim 2 wherein:

said operating means comprises a toggle mechanism located at an extremity of said movable contact carrier structure remote from said movable contact element, said toggle mechanism having a first linkage arm having, at a first extremity, a first elongated slot that slidably engages an actuator pin on said movable contact carrier structure and having, at a second extremity, a pivotal connection with second and third linkage arms at a pivot pin, said second linkage arm having an extremity away from said pivot pin with a second elongated slot slidably engaged to a fixed housing portion and having a compression spring thereon, said third linkage arm having an extremity away from said pivot pin connected to an armature of an electromagnetic device, said third linkage arm having an extremity at said pivot pin with a slot extending transverse to the length of said third linkage arm, said pivot pin extending through said slot of said third linkage arm, said slot taking an inclined position in relation to a plane parallel to said movable contact element to prevent said mechanism from having a dead center position.

* * * * *